US005181075A

United States Patent [19]

Rubin

[11] Patent Number: 5,181,075

[45] **Date of Patent: * Jan. 19, 1993**

[54] DEVELOPMENT APPARATUS HAVING AN EXTENDED DEVELOPMENT NIP

[75] Inventor: Bruce J. Rubin, Rochester, N.Y.

[73] Assignee: Eastman Kodak Company, Rochester, N.Y.

[ * ] Notice: The portion of the term of this patent subsequent to Jan. 14, 2009 has been disclaimed.

[21] Appl. No.: 719,904

[22] Filed: Jun. 24, 1991

[51] Int. Cl.[5] ..... G03G 15/09

[52] U.S. Cl. ..... 355/259; 118/657; 355/251

[58] Field of Search ..... 355/245, 246, 251, 253, 355/259; 118/656, 657

[56] References Cited

U.S. PATENT DOCUMENTS

| | | | |
|---|---|---|---|
| 3,879,737 | 4/1975 | Lunde | 355/251 X |
| 4,235,549 | 11/1980 | Eisbein et al. | 355/251 X |
| 4,287,850 | 9/1981 | Yamamoto et al. | 118/657 |
| 4,707,107 | 11/1987 | Joseph | 355/253 |
| 4,804,994 | 2/1989 | Sasaki et al. | 118/657 X |
| 4,928,145 | 5/1990 | Okamoto et al. | 355/245 |
| 4,980,728 | 12/1990 | Funayama et al. | 355/251 |
| 5,080,038 | 1/1992 | Rubin | 118/657 |

FOREIGN PATENT DOCUMENTS 55-39406 9/1980 Japan .

*Primary Examiner*—A. T. Grimley
*Assistant Examiner*—Nestor R. Ramirez
*Attorney, Agent, or Firm*—Tallam I. Nguti

[57] ABSTRACT

A development apparatus for developing images on an image-bearing surface being moved through a fixed path in a copier or printer includes a magnetic development brush that has a rotatable magnetic core generating a first magnetic field thereabout, and a non-magnetic shell which forms a development nip with the image-bearing surface. The non-magnetic shell is contoured within the development nip so as to follow the shape of the fixed path of the image-bearing surface through such nip. The development brush further includes nip extending shoulder sections, and magnet keepers for forming field magnets within the first magnetic field of the magnetic core. The magnet keepers each generate an auxiliary magnetic field for enhancing and increasing the strength of a resultant magnetic field at and about the shoulder sections thereby enabling the continued forming of a consistent and desirably thick developer material nap around the extended shoulder sections.

10 Claims, 2 Drawing Sheets

DEVELOPMENT APPARATUS HAVING AN EXTENDED DEVELOPMENT NIP

CROSS-REFERENCE TO A RELATED APPLICATION

This application is related to U.S. application Ser. No. 07/720,031, entitled EXTENDED NIP DEVELOPMENT APPARATUS HAVING A TRANSPORT ASSIST MAGNET, filed in the name of Bruce J. Rubin on even date herewith.

BACKGROUND OF THE INVENTION

1. Field of the Invention

The present invention relates to electrostatographic development apparatus, and more particularly to such a development apparatus including a magnetic development brush that has an extended development nip.

2. Description Relative to the Prior Art

Development apparatus are well known for use in an electrostatographic reproduction apparatus, such as in a copier or printer, for developing latent images which are formed electrostatically on an image-bearing surface. Such development apparatus include those having magnetic development brushes as disclosed, for example, in Japanese Patent No. Sho 55 (1980)-39406; U.S. Pat. Nos. 4,235,549 issued to Eisbein et al., 4,287,850 issued to Yamamoto et al.; and 4,928,145 issued to Okamoto et al.

As disclosed in each of the above patents, a magnetic development brush of such a development apparatus consists of a generally cylindrical magnetic core and a generally cylindrical non-magnetic shell surrounding such core. When the development apparatus is mounted for operation in a copier or printer, for example, the non-magnetic shell of the magnetic brush is located spaced from, and forms a development nip or footprint with the image-bearing surface in such a copier or printer. The magnetic core of the magnetic brush functions to attract magnetic developer material contained within the development apparatus onto the surface of the non-magnetic shell thereof thereby forming a magnetic developer material nap on such shell. Rotation of the magnetic core then causes such an attracted developer material nap to move or be transported over the surface of the shell, into and through the development nip where such nap contacts and develops electrostatic latent images on the image-bearing surface.

The quality of the images so developed depends in significant part, for example, (a) on the nature and height or thickness of the developer material nap being transported as above through the development nip; and (b) on the length of development time, that is, the time during which the latent images on the image-bearing surface are in actual contact with such a developer material nap. At any given development apparatus speed, such development time is determined of course by the size of the nip width or footprint of the development nip. As disclosed for example in the '549 patent to Eisbein and in the '850 patent to Yamamoto, the development quality of such images can be improved in part by providing means for increasing the width of the development nip, in other words, means for increasing the size of the nip width or footprint of the development nip.

Unfortunately, however, such an improvement alone does not ensure the consistency and desired thickness of the developer material nap, and alone can very easily be counteracted by an increase in the throughput speed of the development apparatus. Accordingly, there is still a need to provide means for significantly increasing the size of the nip width or footprint of a magnetic development brush while also still substantially providing a consistent and desirably thick developer material nap for transportation through such an extended development nip.

SUMMARY OF THE INVENTION

It is an object of the present invention to provide a magnetic brush development apparatus that has an extended development nip and that provides a consistent and desirably thick magnetic developer material nap for transportation through such an extended development nip.

In accordance with the present invention, a development apparatus is provided which includes a housing and a magnetic development brush that has a magnetic core and a non-magnetic shell. The non-magnetic shell surrounds the magnetic core and forms a development nip with an image-bearing surface for developing latent images on such a surface using magnetic developer material. The magnetic core generates a first magnetic field which has a desired magnetic strength region about the non-magnetic shell for forming a magnetic developer material nap that has a desired thickness thereto.

The non-magnetic shell has a first portion located within the desired magnetic strength region of the first magnetic field of the magnetic core, and a second portion which includes an extended shoulder section that is associated with at least one side of the development nip thus increasing the width of the development nip. The shoulder section, as such, extends the one side of the development nip beyond the desired magnetic strength region of the first magnetic field of the magnetic core.

The magnetic brush further has a magnet keeper mounted within the non-magnetic shell so as to lie partially within the desired magnetic strength region of the first magnetic field of the magnetic core, and partially within the extended shoulder section to form a field magnet thereat. As a field magnet, the magnet keeper generates an auxiliary magnetic field for enhancing and increasing the strength of a resultant magnetic field around the extended shoulder section so as to enable the continued forming of a magnetic developer material nap, that has a desired thickness about the shoulder section.

BRIEF DESCRIPTION OF THE DRAWINGS

In the detailed description of the invention presented below, reference is made to the drawings, in which.

DETAILED DESCRIPTION OF THE PREFERRED EMBODIMENT

Because electrostatographic reproduction apparatus or machines are well known, the present description will be directed in particular to elements forming part of or cooperating more directly with the present invention. Elements not specifically shown or described herein are selectable from those known in the prior art.

Figure 1:
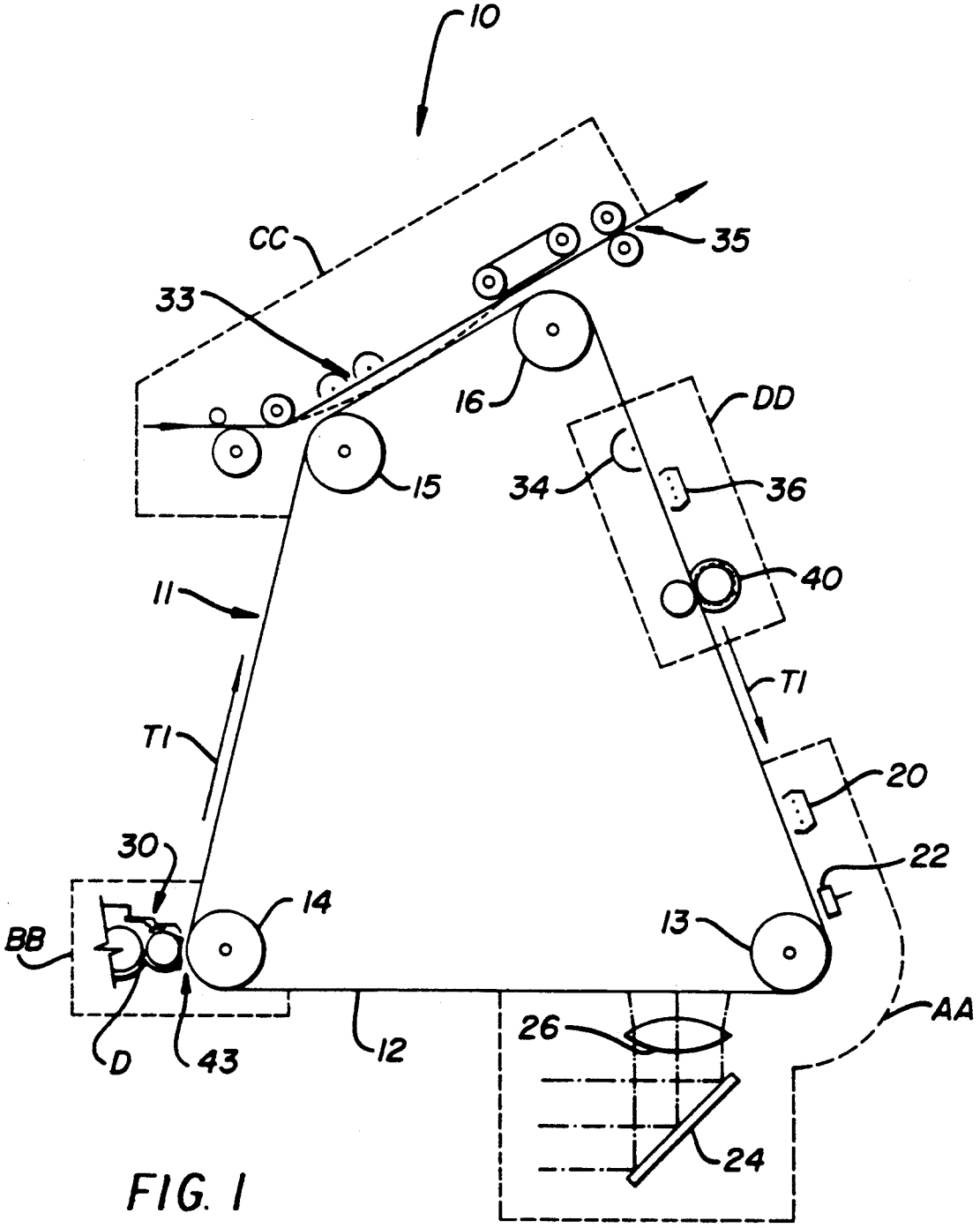
FIG. 1 is a schematic of an electrostatographic machine such as a copier or printer including the development apparatus of the present invention.

Referring now to FIG. 1, an electrostatographic reproduction apparatus or machine such as an optical copier is shown generally as 10. The apparatus 10, as shown, includes an image-bearing member 11 which is an endless flexible photoconductive belt that has a frontside image-bearing surface 12. Although the member 11 is shown as an endless flexible web trained about the series of rollers 13–16, it should be understood that an image-bearing member in the form of a rigid drum can also be used. The member 11, as shown, is trained about the series of rollers 13–16 for movement in the direction, for example, of the arrow T1. One of the rollers, such as the roller 13, can be a drive roller for repeatedly moving the member 11 so that its surface 12 maintains a fixed path, as shown, while being moved sequentially through a series of electrostatographic process stages shown, for example, as AA, BB, CC and DD.

As shown in FIG. 1, clean and charge-free portions of the image-bearing member 11 initially move through the stage AA where electrostatic charges and/or light, are used in one manner or another (as is well known in the art) to electrostatically form, on the surface 12, latent images of an original document. Typically, the stage AA includes components such as a primary charger 20 or other charge depositing component (not shown). The latent image of an original can thus be formed electrostatically on the image-bearing surface 12, for example, by first uniformly charging the surface 12 to a suitable potential using the primary charger 20, and then imagewise discharging portions of such surface using, for example, an electronic printhead 22 or the like, and/or an optical system as shown partially. A typical optical system includes a light source (not shown) that illuminates a document sheet. The light rays reflected by a mirror such as 24 can then be reflected through a lens 26, and onto the surface 12 for such optical imaging.

The imaged portion of the image-bearing surface 12 of member 11 next moves to the stage BB where the latent image thereon is developed, that is, made visible, with charged particles of toner. Stage BB therefore includes a development apparatus, such as the development apparatus of the present invention, shown generally as 30. The development apparatus 30 of the present invention (to be described in detail below) contains magnetic developer material D, for example a two-component magnetic developer material that is comprised of magnetic carrier particles and charged toner particles. The magnetic developer material is used therein for developing the latent image on the surface 12 of member 11. During such image development, the charged toner particles in the developer material D transfer to the image-bearing surface 12, and there adhere to the latent electrostatically formed image thereon, thereby making the image visible.

After such development, that portion of the image-bearing member 11 carrying the toner image thereon, then moves to the stage CC. The stage CC, as shown, includes an image transfer station 33 where the visible toner image on the surface 12 is transferred to a suitable receiver sheet, such as a sheet of plain paper, which is fed in registration to the station 33 along a sheet travel path. After such image transfer, the copy sheet then travels to a fusing station 35, as shown, where the toner image is permanently fused to the receiver sheet to form a hard copy.

Meanwhile, the used portion of member 11, from which the toner image was transferred, moves on towards the initial stage AA to again begin another imaging cycle. To ensure continued production of high quality hard copies during subsequent cycles of the above imaging process, each such used portion of the surface 12 must be cleaned before it is again reused. Such cleaning effectively removes any residual charges and residual particles remaining on the surface 12 following image transfer. Accordingly, such cleaning is carried out at the stage DD where residual charges are removed by a discharge lamp 34 and/or neutralized by a corona charger 36, for example, and residual particles are removed by a cleaning apparatus shown, for example, as 40.

Figure 2:
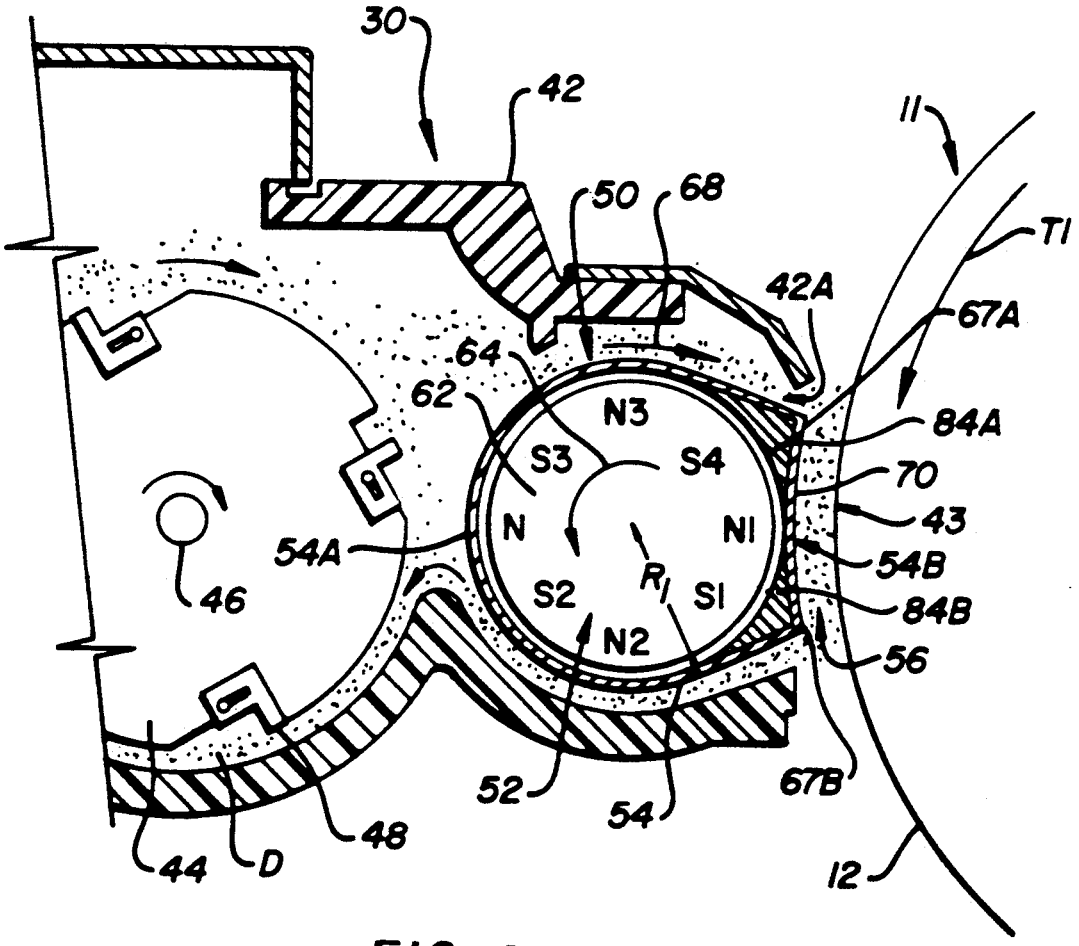
FIG. 2 is an end view, partly in section of the development apparatus of FIG. 1 forming a generally vertical development nip with the image-bearing surface.

Referring now to FIG. 2, the development apparatus 30 of the present invention is illustrated in detail. As shown, the development apparatus 30 includes a housing 42 which has a development opening 42A, and which is mountable adjacent the fixed path of the image-bearing member 11, along a segment 43 thereof (FIG. 1), such that the development apparatus 30 as shown forms a generally vertical or 9 o'clock position development nip for example with the image-bearing surface 12 of the member 11. The housing 42 can also be mounted so that the development apparatus 30 given the same view forms a generally vertical or 3 o'clock position development nip with such surface 12. Although the development apparatus 30 (FIG. 1) is shown mounted along a curved segment 43 of the fixed path of the surface 12, it is understood that for purposes of this invention the development apparatus 30 is equally adaptable for mounting along a flat segment of the fixed path of such surface 12.

Within the housing 42 of the development apparatus 30, means such as a ribbon blender assembly (not shown) can be mounted in a sump portion thereof for containing, mixing and moving magnetic developer material D. For an example of such a ribbon blender, see commonly assigned U.S. Pat. No. 4,707,107 issued Nov. 17, 1987 in the name of Brian J. Joseph The housing 42 also includes a developer material transport roller shown as 44 that is mounted for rotation for example about a shaft 46. The transport roller 44 can include a plurality of bucket members each shown as 48 for carrying developer material D about such roller 44 during rotation of the roller 44.

Still referring to FIG. 2, the development apparatus 30 further includes a magnetic development brush or roller designated generally as 50. As shown, the development brush or roller 50 includes a rotatable magnetic core 52 and a stationary non-magnetic shell 54. The magnetic development brush or roller 50 is mounted within the housing 42 so as to be immediately adjacent to the developer material transport roller 44, and such that a portion of the non-magnetic shell 54 thereof projects beyond the housing 42 through the opening 42A. The development apparatus 30 is then mountable within a reproduction apparatus 10 so that the portion of the shell 54 which projects through the development opening 42A is slightly spaced from, and forms a development nip 56 with the surface 12 of the member 11. As such, the magnetic development brush or roller 50 can function to magnetically attract magnetic developer material from the adjacent transport roller 44, and to then magnetically carry such developer material into and through the development nip 56 where such developer material contacts and develops latent images on the surface 12.

As shown, the rotatable magnetic core 52 of the development brush 50 includes a series of alternating pole permanent magnets 62 that are concentrically arranged thereabout. The magnetic core 52 is rotatable, for example, in the direction of the arrow 64. Each magnet 62 generates a first magnetic field that has a first desired strength region within a first distance or radius R1 about the magnetic core 52. The strength of each first magnetic field within this region having a radius R1 should be sufficient to produce a magnetic developer material nap on the non-magnetic shell which has a desired thickness and consistency for high-quality image development. As is known, rotation of the alternating pole magnets 62 of the core 52 in one direction, for example in the counterclockwise direction as shown, will cause magnetic developer material on the surface of the non-magnetic shell 54 to move in the opposite direction.

Referring still to FIG. 2, the stationary non-magnetic shell 54 of the development brush 50 includes a first portion 54A, and a second such portion 54B. As shown, the development brush 50 is mounted within the housing 42 such that the first portion 54A thereof is located immediately adjacent the developer material transport roller 44 and within the desired strength region of the first magnetic field of each core magnet 62. As such, a magnetic developer material nap of the desired consistency and thickness can be attracted to such first portion 54A. The shape of this first portion 54A is shown as being generally cylindrical, having the radius R1, but it can be any suitable shape that will permit the effective attraction of developer material from the buckets 48 of the transport roller 44 onto such portion under the magnetic influence of the core magnets 62.

As further shown, the second nip-forming portion 54B of the non-magnetic shell 54 is locatable, for example, along the segment 43 (FIG. 1) of the fixed path of the image-bearing surface 12, such that it is spaced therefrom, and forms the development nip 56. Second portion 54B includes at least one of or a pair of shoulder sections 67A, 67B which extend remotely beyond the magnetic core 52. The sections 67A, 67B as shown thus extend each respective entrance and exit sides of the development nip 56 beyond the radius R1 and hence beyond the desired strength region of the first magnetic field of each core magnet 62. Consequently, the extended sections of the second portion 54B will ordinarily lie in a weaker magnetic field region of the first magnetic field due to their remoteness from the core magnets 62.

As shown, the sections 67A and 67B each has a surface 70 that is contoured or shaped such that externally it follows the shape or contour of the fixed path of the surface 12, for example along the segment 43 (FIG. 1). Along such segment, the fixed path of the surface 2 can be substantially flat, or as shown, it can be curved, segment 43 (FIG. 1). Accordingly, as shown in FIG. 2, the sections 67A, 67B of the second portion 54B should each have a generally curved outer surface 70 that is spaced from, but follows the curved path of the surface 12 from one side to the other of the extended development nip 56.

In the development apparatus 30 of the present invention, developer material D containing magnetic or magnetizable carrier particles can be moved by the transfer roller 44 using the buckets 48 into the magnetic attraction of the core magnets 62. There, the magnetic developer material D is attracted onto the outside surface of the first portion 54A of the shell 54. As is known, the attracted magnetic developer material D forms a brush-like nap thereon, which should have a desired thickness or height. The nap thereafter is moved or transported around the surface of the non-magnetic shell 54 by rotation of the core magnets 62. However, the actual thickness and nature of such a developer material nap at any point along the surface of the non-magnetic shell will depend significantly on the strength of the magnetic field at and about such a point. For example, a stronger than average magnetic field at a particular point will result in a thicker than average magnetic developer material nap, and a weaker than average magnetic field at another point will result in a nap that is shorter or thinner. As pointed out above, rotation of the magnets 62 of the core 52 in one direction as shown, for example, will cause the brush-like nap of the magnetic developer material D on the shell 54 to move or be transported in the opposite direction, as shown for example by the arrow 68. The magnetic developer material nap thus can be moved around the shell 54, into and through the extended nip 56 where it contacts and develops latent images on the surface 12.

In accordance with the present invention, the magnetic development brush 50 further includes magnet keepers 84A, 84B each comprised of a magnetizable material, for example, iron or the like, that exhibits ferromagnetism. As such, when located within a magnetic field, such as the first magnetic field of the rotating magnets 62, such a first magnetic field will induce field magnetization in the keepers 84A, 84B therefore making each magnet keeper 84A, 84B act as a field magnet. Such a field magnet then exhibits an appropriate auxiliary magnetic field of its own. As shown, the magnet keepers are mounted to lie partially inside the radius R1 and hence within the desired strength region of the first magnetic field of the core magnets 62, and to then extend respectively into the remote areas of the shoulder sections 67A, 67B. Accordingly, each magnet keeper 84A, 84B will be magnetized and thus will form a field magnet within its respective remote shoulder section.

Ordinarily, the strength of the first magnetic field of the core magnets 62 within each shoulder section 67A, 67B would be weakened by the remoteness of each shoulder section from such core magnets 62, and therefore will not be as great as the strength of the same first magnetic field is for example in the midpoint of the nip 56 between the sections 67A, 67B. As located, the magnet keepers 84A, 84B will extend to, and act as field magnets near the entrance and exit sides of the extended development nip 56, and therefore will each generate an auxiliary magnetic field that reaches well within these remote areas of the shoulder sections experiencing an ordinarily weakening first magnetic field of the rotating core magnets 62.

Accordingly, the auxiliary magnetic field of strength thereat of the otherwise weakening first magnetic field of the core magnets 62. The result is a resultant magnetic field at and about the remote shoulder sections 67A, 67B having a magnetic strength that can be maintained at substantially the same level as the magnetic field strength within the desired magnetic strength region of the first magnetic field of the core magnets 62. Increasing and maintaining the magnetic field strength, as such, at and about the remote shoulder sections 67A, 67B of the extended development nip 56, thus ensures that a consistent and desirably thick developer material nap will be maintained at and about such sections 67A, 67B, as the developer is being moved over such sections into and through the extended development nip 56. Accordingly, high-quality image development can be achieved through the provision of an extended development nip 56, and of means 84A, 84B for maintaining a consistent and desirably thick developer material nap into and through such nip.

The invention has been described in detail with particular reference to a presently preferred embodiment, but it will be understood that variations and modifications can be effected within the spirit and scope of the invention.

What is claimed is:

1. A development apparatus for developing latent images on an image-bearing surface using magnetic developer material, the development apparatus including;

(a) a housing;

(b) a magnetic development brush having a magnetic core, and a non-magnetic shell for forming a development nip with the image-bearing surface, said magnetic core generating a first magnetic field having a first magnetic strength region adjacent the core, said non-magnetic shell having a first portion located within said first magnetic strength region of said first magnetic field, and a second portion including an extended shoulder section associated with at least one side of said development nip for increasing the width of said development nip, said shoulder section extending said one side of said development nip into a second region beyond said first magnetic strength region of said first magnetic field; and (c) a magnetizable material mounted between said non-magnetic shell and said magnetic core so as to lie partially within said first magnetic strength region of said first magnetic field, and partially within said shoulder section, said magnetizable material due to said first magnetic field forming a field magnet, and generating an auxiliary magnetic field at and about said extended shoulder section for enhancing and increasing the strength of a resultant magnetic field at and about said shoulder section, thereby enabling the forming of a magnetic developer material nap having a desired consistency and thickness at and about said shoulder section.

2. A development apparatus for moving magnetic developer material into development contact with a latent image on an image-bearing surface that is movable along a fixed path in an electrostatographic reproduction apparatus, the magnetic development apparatus comprising:

(a) a housing including a development opening for location adjacent the fixed path of the image-bearing surface;

(b) means for containing and moving magnetic developer material within said housing; and (c) a magnetic development brush for forming a development nip with the image-bearing surface along a suitable segment of the fixed path of the image-bearing surface, and for transporting a magnetic developer material nap from within said housing through said development nip such that the development material nap contacts and develops latent images on the image-bearing surface, the magnetic development brush comprising:

(i) a rotatable magnetic core having alternating pole magnets, each said magnet of said core generating a first magnetic field having a first magnetic strength region;

(ii) a stationary non-magnetic shell surrounding said magnetic core, said non-magnetic shell having a first portion located within said first magnetic strength region of said first magnetic field, and a second portion associated with said development opening for forming a development nip with the image-bearing surface, said second portion including an extended shoulder section for increasing the width of said development nip into a second region beyond said first magnetic strength region of said first magnetic field, said shoulder section being locatable along and spaced from said suitable segment of the fixed path of the image-bearing surface, and said shoulder section having a surface contoured to follow said fixed path of the image-bearing surface within said suitable segment thereof; and (iii) a magnetizable material mounted to lie within said first magnetic strength region of said first magnetic field and within said extended shoulder section, said magnetizable material due to said first magnetic field forming a field magnet, and generating a second auxiliary magnetic field for enhancing and increasing the magnetic field strength of a resultant magnetic field at and about said shoulder section, thereby enabling the continued forming of a magnetic developer material nap having a desired consistency and thickness around said shoulder section of said second portion of the non-magnetic shell.

3. The development apparatus of claim 2 wherein said non-magnetic shell of said development brush includes first and second said shoulder sections for increasing the width of the development nip to the entrance and exit sides thereof.

4. The development apparatus of claim 2 wherein said first portion of said non-magnetic shell is substantially cylindrical.

5. The development apparatus of claim 3 including first and second said magnetizable materials mounted with respect to said first and second shoulder sections.

6. The development apparatus of claim 5 wherein each said magnetizable material consists of a magnetizable iron member.

7. The development apparatus of claim 5 wherein each said magnetizable material is mounted so as to lie within said first magnetic strength region of said first magnetic field of each said magnet of the magnetic core so as to become magnetized.

8. The development apparatus of claim 5 wherein within each said shoulder section, the magnetic strength of said first magnetic field of each said magnet of the magnetic core is greater than the magnetic strength of said second magnetic field of said magnetizable material.

9. A development apparatus for developing latent images using developer material having magnetic carrier particles, the developer apparatus comprising:

(a) a housing;

(b) a magnetic development brush having (i) a rotatable magnetic core generating a first magnetic field for holding and moving magnetic developer material on said magnetic brush; and (ii) a stationary non-magnetic shell surrounding said magnetic core for forming a development nip with an image-bearing surface, said non-magnetic shell being shaped to conform to the contour of the image-bearing surface from an entrance side to an exit side of said development nip; and said non-magnetic shell having outwardly projecting portions at said entrance and exit sides of said development nip; and (c) a magnetizable member mounted inside said non-magnetic shell within at least one of said outwardly projecting portions at said entrance and exit sides of said development nip for enhancing the magnetic strengths of said first magnetic field within and about said at least one outwardly projecting portion of said shell.

10. The development apparatus of claim 9 including said magnetizable member within each of said outwardly projecting portions of said entrance and exit sides of said development nip.

* * * * *